US006820869B2

(12) United States Patent
Lange et al.

(10) Patent No.: US 6,820,869 B2
(45) Date of Patent: Nov. 23, 2004

(54) VARIABLE FOLDER

(75) Inventors: Klaus-Ulrich Lange, Gersthofen (DE); Helmut Schnell, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 45 days.

(21) Appl. No.: 10/074,651

(22) Filed: Nov. 13, 2001

(65) Prior Publication Data

US 2002/0113355 A1 Aug. 22, 2002

(30) Foreign Application Priority Data

Nov. 10, 2000 (DE) ..... 11 55 867

(51) Int. Cl.[7] ..... B41F 13/60

(52) U.S. Cl. ..... 270/42; 270/41; 493/340; 493/345; 493/363; 493/368; 83/678; 225/100

(58) Field of Search ..... 270/6, 5.02, 32, 270/40, 41, 42, 43, 52.07, 52.09, 52.1, 52.12; 493/340, 345, 346, 363, 367, 365, 366, 368; 225/100; 83/678

(56) References Cited

U.S. PATENT DOCUMENTS 1,868,779 A * 7/1932 Tornberg ..... 270/42
3,967,767 A * 7/1976 Seragnoli ..... 225/96
4,473,218 A 9/1984 Dudek ..... 270/52.5
4,490,132 A * 12/1984 Ogura et al. ..... 493/424
4,491,310 A * 1/1985 Reffert ..... 270/49
4,564,470 A * 1/1986 Schmitt ..... 270/21.1
4,957,280 A 9/1990 Motooka
4,974,822 A * 12/1990 Richter ..... 270/48
5,386,979 A * 2/1995 Muller ..... 270/42
5,405,126 A * 4/1995 Mack ..... 270/6
5,695,105 A * 12/1997 Ohara ..... 225/96
5,807,227 A * 9/1998 Field ..... 493/424
5,882,287 A 3/1999 Kuckhermann
6,454,692 B2 * 9/2002 Ganneval et al. ..... 493/424

FOREIGN PATENT DOCUMENTS

| | | | |
|---|---|---|---|
| DE | 39 00 663 A1 | 7/1989 | |
| EP | 0 376 754 A2 | 7/1990 | ..... B65H/35/10 |
| EP | 0 506 193 A1 | 9/1992 | ..... B65H/35/10 |
| EP | 0 625 476 A1 | 11/1994 | |
| GB | 2 234 998 A | 11/1998 | ..... B65H/35/10 |

* cited by examiner

*Primary Examiner*—Patrick Mackey
(74) *Attorney, Agent, or Firm*—Cohen, Pontani, Lieberman & Pavane

(57) ABSTRACT

In order to provide a variable folder which allows smearing-free operation, the cutting blade of an upstream cross-cutting arrangement is provided with recesses, which leave behind residual crosspieces in the strand which is to be cut, and arranged in the product-directing region, between the cross-cutting arrangement and a collecting cylinder, are accelerating and tearing-off cams which grip the incoming product and tear it off from the strand at the residual crosspieces.

10 Claims, 3 Drawing Sheets

VARIABLE FOLDER

BACKGROUND OF THE INVENTION

1. Field of the Invention

The invention relates to a variable folder having a cross-cutting arrangement with a cutting cylinder provided with at least one cutting blade. The variable folder also has a collecting cylinder and a product directing arrangement which leads from the cross-cutting arrangement to the collecting cylinder.

2. Description of the Related Art

DE 33 02 036 A1 discloses a variable folder in which a fed web strand is cross cut in a cross-cutting arrangement. The resulting products are accelerated by a directing belt and fed to a collecting cylinder. In this case, the accelerating belts execute movements relative to the products and smear the print. There is also a risk of the strand winding around a cylinder of the cross-cutting arrangement following the cut.

DE 39 00 663 C2 discloses an apparatus which is intended for cross cutting webs and in which the web is cut in two stages by two cutting apparatuses. First of all a cut which is interrupted by a multiplicity of crosspieces is executed. The second cross-cutting arrangement then produces a continuous cut by virtue of the crosspieces being severed. Such an interrupted cut is used in order for it to be possible for belts of a directing belt to be guided through beneath the cutting blade in the cut-free region. The two cutting apparatuses result in the apparatus being costly to produce.

SUMMARY OF THE INVENTION

The object of the invention is to provide a variable folder which allows smearing-free operation.

In accordance with the invention, the cutting blade has plural recesses so that residual cross pieces are left behind in the strand which has been cut. Arranged in a product-directing region between the cross-cutting arrangement and the collecting cylinder are accelerating and tearing-off cams which grip the product and tear it off from the strand at the residual cross pieces.

By virtue of the accelerating and tearing-off cams, the print-smearing directing belts are rendered superfluous. The accelerating and tearing-off cams may be arranged in the print-free border regions and in the likewise print-free central region. This does away with problematic sources which cause the print to smear. It is also possible for webs which are printed with cold-set inks to be processed without smearing. Furthermore, by virtue of the strand not being completely severed, the start of a product, via the connection to the preceding product by way of the residual crosspieces, is guided reliably out of the cutting zone of the cross-cutting arrangement, with the result that wrap-around is avoided. The strand which has not been completely cross cut thus initially retains its web character.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
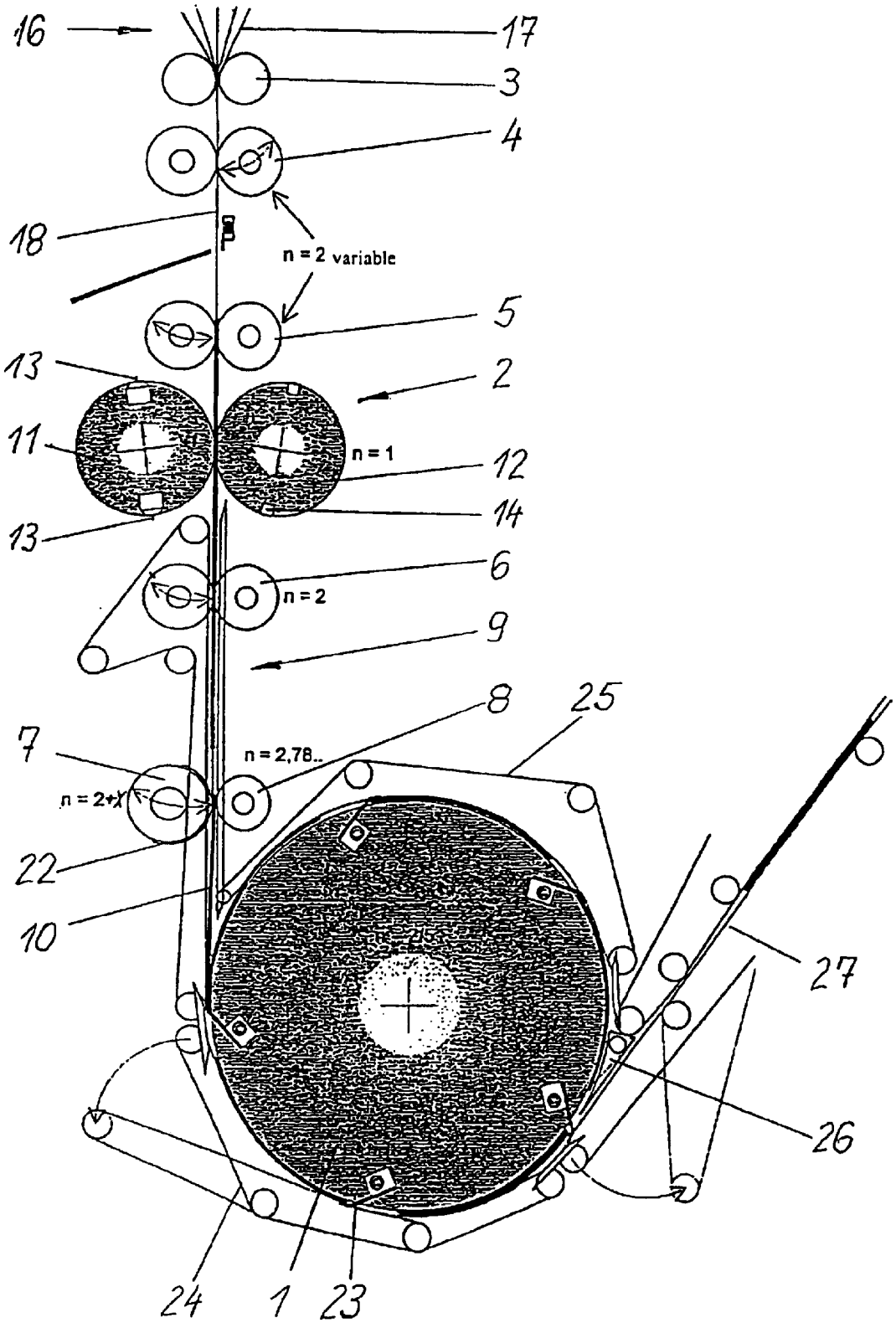
FIG. 1 is a cross-sectional view of a variable folder according to an embodiment of the present invention.
Figure 4:
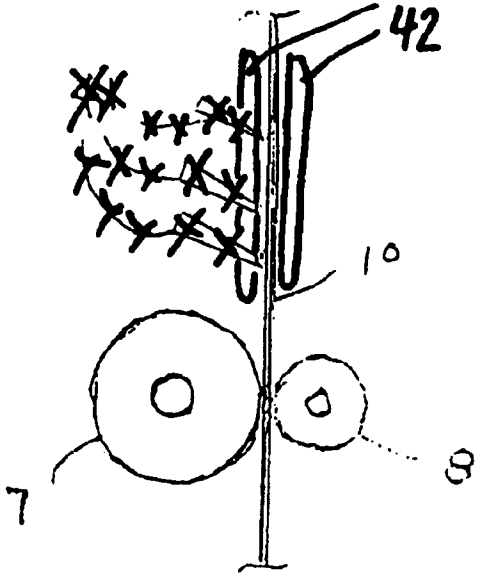
FIG. 4 is a diagramictic fragmentary diagram showing tongues used for the product-directing arrangement.

The variable folder shown in FIG. 1 contains a collecting cylinder 1, which is provided, for example, with grippers 23, and a cross-cutting arrangement 2, which is arranged upstream of said collecting cylinder. Run-in rollers 3 and a first and a second drawing arrangement 4, 5 are arranged, one after the other, upstream of the cross-cutting arrangement 2, as seen in the web-running direction. The cross-cutting arrangement 2 is followed by a third drawing arrangement 6 and accelerating and tearing-off cams 7. The tearing-off cams 7 interact with a driven roller 8. For the purposes of minimizing wear and increasing the service life, the ratio of the speeds of the roller 8 to the accelerating and tearing-off cams 7 is not a whole number. FIG. 1 specifies, by way of example, speeds in relation to a reference speed n. A product-directing arrangement 9 in the form of a belt directing system is arranged between the cross-cutting arrangement 2 and the gripper and collecting cylinder 1. The directing belts of the belt directing system do not press on the products 10 which are to be directed and also do not subject the latter to any accelerating or decelerating forces. It is also possible to use, for example, tongues 42 as the product-directing arrangement 9 as shown in FIG. 4.

Figure 2:
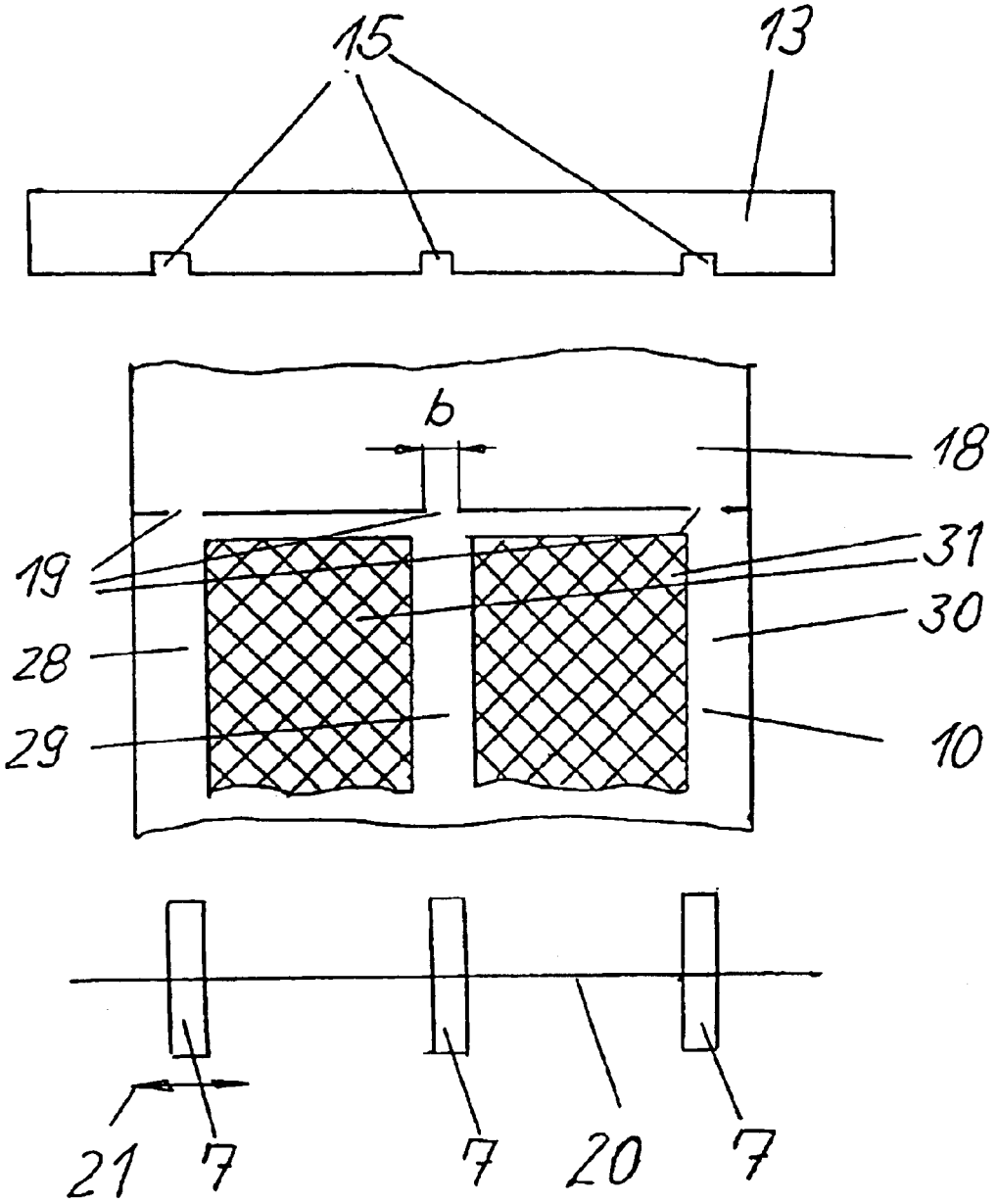
FIG. 2 is a view of the strand, the cutting blade and the accelerating and the tearing-off cam which shows the manner in which a cutting blade of the cross-cutting arrangement and the accelerating and tearing-off cams are arranged in respect of the strand which is to be processed.

The cross-cutting arrangement 2 contains a cutting cylinder 11 and a grooved cylinder 12. The cutting cylinder is provided with cutting blades 13, in the exemplary embodiment with two cutting blades located opposite one another. A different number of cutting blades 13 is also possible. The grooved cylinder 12 contains two cutting grooves 14. Each cutting blade 13 has three recesses 15 (FIG. 2).

Figure 3:
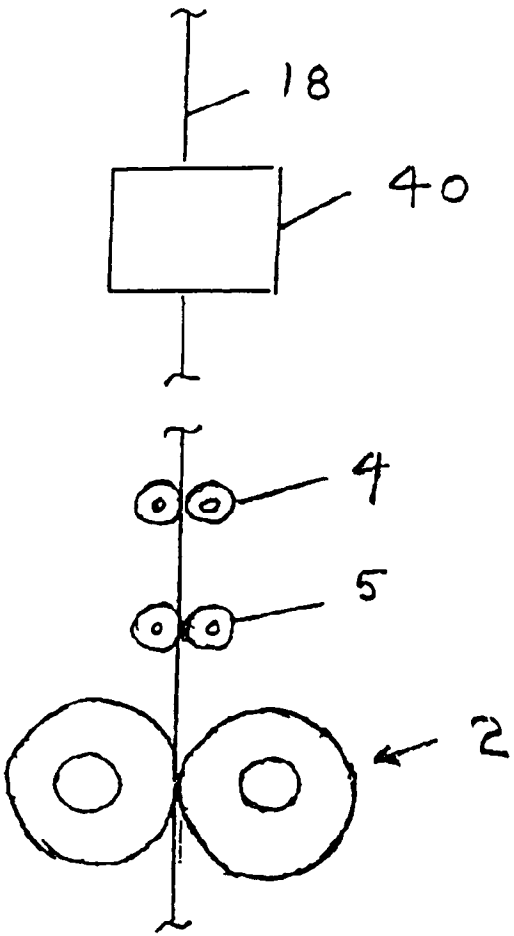
FIG. 3 is a diagrammatic depiction of the relation of first and second drawing arrangements with a printing unit and the cross-cutting arranagement.

At the folding-unit inlet 16, upstream of the run-in rollers 3, webs 17 coming from magazine turner bars or formers are fed to the variable folder. The resulting strand 18 is conveyed on further by the first, second and third drawing arrangements 4, 5, 6 once it has passed through the run-in rollers 3. The drawing arrangements 4, 5, 6 may comprise, in a known manner, drawing rollers for example. The first and second drawing arrangements 4, 5 operate with a lead which can be adjusted variably in relation to upstream printing units 40 (FIG. 3), and are adjusted in this respect such that the strand 18 is fed to the cross-cutting arrangement 2 with the necessary web tensioning. The third drawing arrangement 6 is operated at the circumferential speed of the first and second drawing arrangements, with the result that the strand 18 passes through the cross-cutting arrangement 2 with the necessary web tensioning.

The cross-cutting arrangement 2 does not cut through the strand 18 completely. On account of the recesses 15 in each cutting blade 13, residual crosspieces 19 (see FIG. 2) with, for example, a width b of 4 mm in each case remain in the strand 18. The recesses 15 are advantageously provided in the cutting blade 13 such that the residual crosspieces 19 are positioned in print-free regions 28, 29, 30 of the strand 18, in this case in the border regions and in the centre of the strand, alongside the printed surface areas 31.

The accelerating and tearing-off cams 7 are advantageously provided in equal number to the residual crosspieces 19 and are advantageously arranged in planes containing the residual crosspieces 19 and/or in the print-free regions 28, 29, 30. For adjustment in this respect, the accelerating and tearing-off cams 7 can be displaced axially on a shaft 20 bearing them, this being indicated by a double arrow 21.

The accelerating and tearing-off cams 7 each have a cam region 22 by means of which, interacting with the roller 8, they grip and transport the product 10 produced when the strand 18 is cross cut. The lateral surface of the accelerating and tearing-off cams 7 is advantageously wear-resistant and configured with a high coefficient of friction, for example with a diamond coating. The cam regions 22 of the accelerating and tearing-off cams 7 have a higher circumferential speed than the first, second and third drawing arrangements 4, 5, 6. On account of this higher speed, the product 10 is torn off at the residual crosspieces 19 and accelerated to the circumferential speed of the collecting cylinder 1 and fed to the latter. The speed is such that a sufficiently large gap is produced between the products 10 and the products 10 are accommodated reliably, and without being damaged, by the grippers 23 of the collecting cylinder 1.

The product guidance on the collecting cylinder 1 is assisted by product guides or directing belts 24 and 25 which butt against said collecting cylinder and are advantageously driven by the collecting cylinder 1. Collect-run production may also be operated in a known manner. The products 10 are then removed into a directing belt 27 in a customary manner by a controlled removal tongue 26 and fed, for example, to a longitudinal folding apparatus or, once split, to two longitudinal folding apparatuses.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A variable folder having a product strand path extending therethrough, said variable folder comprising:

a cross-cutting arrangement including a cutting cylinder and at least one cutting blade carried on said cutting cylinder functional for cutting a product from a feeding web strand fed along the product strand path, said at least one cutting blade having a plurality of recesses functioning to leave residual crosspieces in said feeding web strand by which said product remains connected to said feeding web strand;

a collecting cylinder located downstream of said cross-cutting arrangement along the product strand path;

a product directing arrangement which leads from said cross-cutting arrangement to said collecting cylinder;

accelerating and tearing-off cams at a location between said cross-cutting arrangement and said collecting cylinder through which said product passes, said accelerating and tearing-off cams operable for gripping said product to tear off said product from said feeding web strand at said residual crosspieces; and a driven roller, said accelerating and tearing-off cams interacting with said driven roller, wherein a ratio of a speed of said driven roller to a speed of said accelerating and tearing-off cams is other than a whole number.

2. A variable folder according to claim 1, wherein said cutting blade has three recesses, said recesses being arranged to register with border regions and a center of said feeding web strand.

3. A variable folder according to claim 1, wherein each residual crosspiece has an accelerating and tearing-off cam associated therewith.

4. A variable folder according to claim 1, wherein said accelerating and tearing-off cams are arranged to register with print-free regions of said feeding web strand.

5. A variable folder according to claim 1, further comprising first and second drawing arrangements arranged one after another upstream of said cross-cutting arrangement, said first and second drawing arrangements each operating at a circumferential speed which is greater than a speed of said feeding web strand received from upstream printing units by a lead which is adjustable.

6. A variable folder according to claim 5, further comprising a third drawing arrangement arranged between said cross-cutting arrangement and said accelerating and tearing-off cams, said third drawing arrangement being operable at the circumferential speed of said first and second drawing arrangements.

7. A variable folder according to claim 6, wherein said accelerating and tearing-off cams are operable at a higher circumferential speed than the circumferential speed at which said first, second and third drawing arrangements are operable.

8. A variable folder according to claim 1, wherein said product-directing arrangement comprises a belt directing system which in operation is product non-engageable.

9. A variable folder according to claim 1, wherein said product-directing arrangement comprises tongues.

10. A variable folder according to claim 3, wherein each of said residual crosspieces and tearing-off cams is arranged in a print-free region of the web strand.

* * * * *

UNITED STATES PATENT AND TRADEMARK OFFICE

CERTIFICATE OF CORRECTION

PATENT NO. : 6,820,869 B2
DATED : November 23, 2004
INVENTOR(S) : Klaus-Ulrich Lange It is certified that error appears in the above-identified patent and that said Letters Patent is hereby corrected as shown below:

Title page,
Item [30], Foreign Application Priority Data, should read
-- Nov. 10, 2000 (DE) 100 55 867 --

Signed and Sealed this

Twenty-fourth Day of May, 2005

JON W. DUDAS
*Director of the United States Patent and Trademark Office*